United States Patent [19]

Vachon

[11] Patent Number: 4,480,397

[45] Date of Patent: Nov. 6, 1984

[54] SNOWBLOWER TRUCK ASSEMBLY AND LATERAL SWIVELLING SNOWBLOWER EQUIPMENT THEREFOR

[76] Inventor: René Vachon, 318A St. Raphaël St., Valleyfield, Canada, J6T 3A6

[21] Appl. No.: 503,863

[22] Filed: Jun. 13, 1983

[30] Foreign Application Priority Data

Mar. 4, 1983 [CA] Canada ..... 422948

[51] Int. Cl.[3] ..... E01H 5/04

[52] U.S. Cl. ..... 37/234; 37/247

[58] Field of Search ..... 37/234, 236, 242, 247, 37/253, 257, 259, 274, 209–210

[56] References Cited

U.S. PATENT DOCUMENTS

| | | | |
|---|---|---|---|
| 1,955,585 | 4/1934 | Holmes | 37/242 |
| 2,101,666 | 12/1937 | Austin | 37/274 X |
| 2,118,851 | 5/1938 | McCallum | 37/236 |
| 2,224,869 | 12/1940 | Jensen | 37/236 |
| 2,241,252 | 5/1941 | Garland et al. | 37/236 |
| 2,299,451 | 10/1942 | Austin | 37/274 X |
| 2,498,522 | 2/1950 | Berg et al. | 37/236 |
| 2,744,341 | 5/1956 | Ulrich | 37/247 |
| 2,858,625 | 11/1958 | Rivinius | 37/247 |
| 3,012,615 | 12/1961 | Pawela | 37/257 |
| 3,332,159 | 7/1967 | Dunn | 37/236 |

FOREIGN PATENT DOCUMENTS

| | | | |
|---|---|---|---|
| 218001 | 2/1942 | Switzerland | 37/253 |
| 665922 | 2/1952 | United Kingdom | 37/274 |

*Primary Examiner*—E. H. Eickholt

[57] ABSTRACT

This snowblower equipment includes a snowblower unit arranged to be readily and removably attached to the rear frame of a truck, and a truck so equipped, such that the rear frame or platform of the truck remains free for conventional trucking, either with or without the snowblower unit attached to it. This snowblower equipment includes a pivot section attached to the rear frame of a truck and at the edge of it, and having a lifting mechanism with upright pivots around which a second pivot section swivels bodily with the snowblower unit fixedly secured to it. The snowblower unit may thus selectively swivel between a lateral projecting position and a rearward projecting position relative to and outward of the rear frame.

1 Claim, 11 Drawing Figures

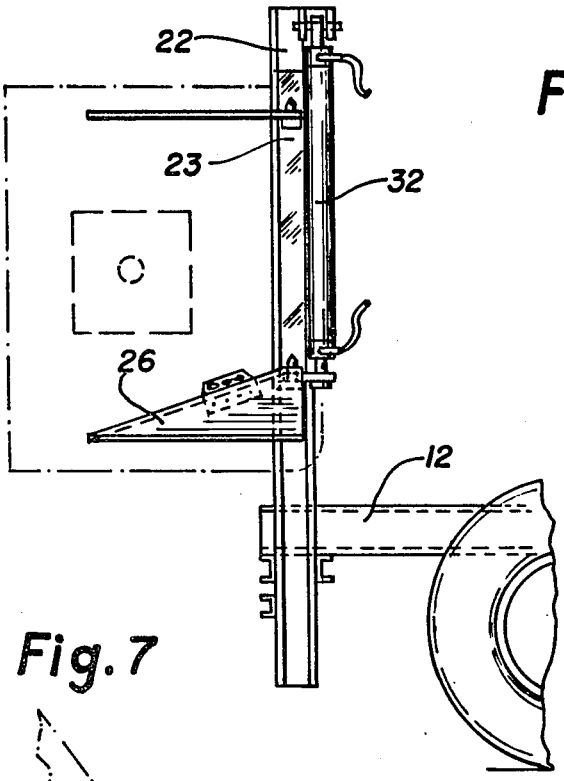
Fig. 7
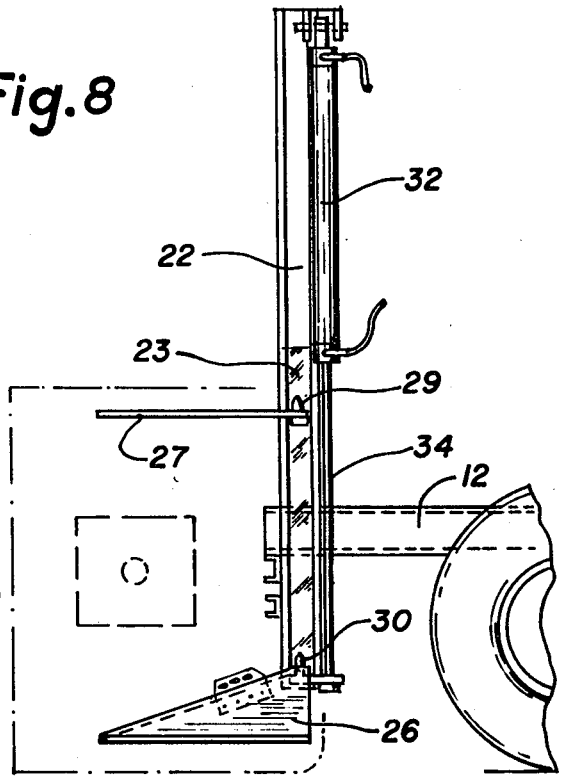
Fig. 8
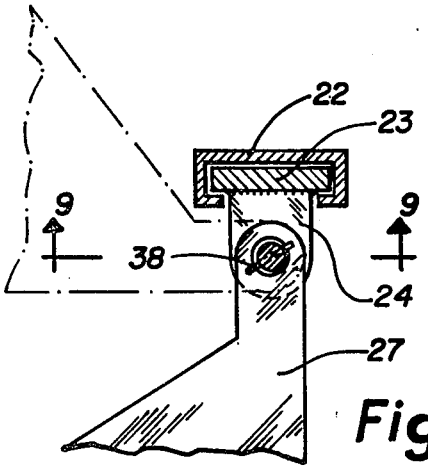
Fig. 10
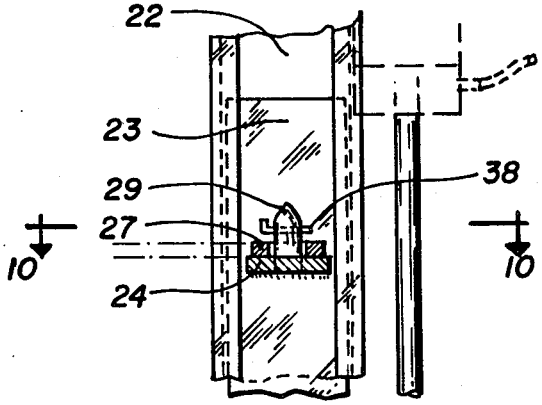
Fig. 9
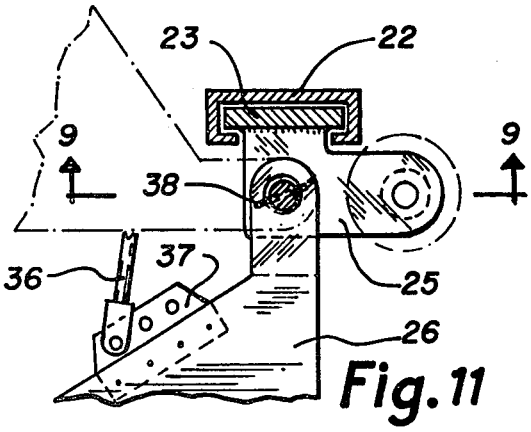
Fig. 11
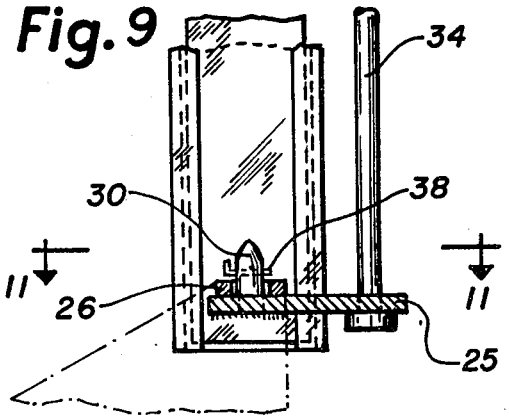

SNOWBLOWER TRUCK ASSEMBLY AND LATERAL SWIVELLING SNOWBLOWER EQUIPMENT THEREFOR

FIELD OF THE INVENTION

This invention relates to a snowblower equipment for a truck and to a snowblower truck equipped with it.

DESCRIPTION OF THE PRIOR ART

The snow is conventionally plowed into snowbanks of substantial sizes along roads and highways, and elsewhere. At times, those snowbanks have to be lowered or entirely removed to make space for other snowplowing and for other practical reasons, such as to allow unobstructed views. In each of the two U.S. Pat. Nos. 2,118,851 and 2,498,522, there is defined a snowblower-equipped truck which has a lateral swivelling snowblower unit which is swivelly connected by a turntable mounted on the platform on the rear frame of the truck. However, even when swivelled to inoperative position at the back of the truck, the snowblower unit exceeds laterally of the truck, which is not permitted on roads.

SUMMARY OF THE INVENTION

It is a general object of the present invention to provide a snowblower equipment and a snowblower-equipped truck assembly conveniently arranged for practical swivelling of a snowblower unit between an operative lateral projection position and an inoperative rearward projecting position.

It is a further object of the present invention to provide a snowblower equipment and a snowblower-equipped truck assembly that are constructed and arranged to readily detach a snowblower unit from the rear frame when not in use.

It is still another object of the present invention to provide a snowblower equipment and a snowblower equipment truck assembly that each includes a snowblower unit, the drive of which is exclusively attached to the snowblower unit to provide simple interconnection between the truck and the snowblower unit.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings, in which:

FIG. 7 is an elevation view as seen along line 7—7 in FIG. 5 and showing the lifting mechanism in upward position;

FIG. 8 corresponds to FIG. 7 but with the lifting mechanism in lowered position;

FIG. 9 is a cross-sectional view as seen along line 9—9 in FIGS. 10 and 11; and FIGS. 10 and 11 are cross-sectional views as seen along lines 10—10 and 11—11, respectively.

DESCRIPTION OF THE PREFERRED EMBODIMENT

Figure 1:
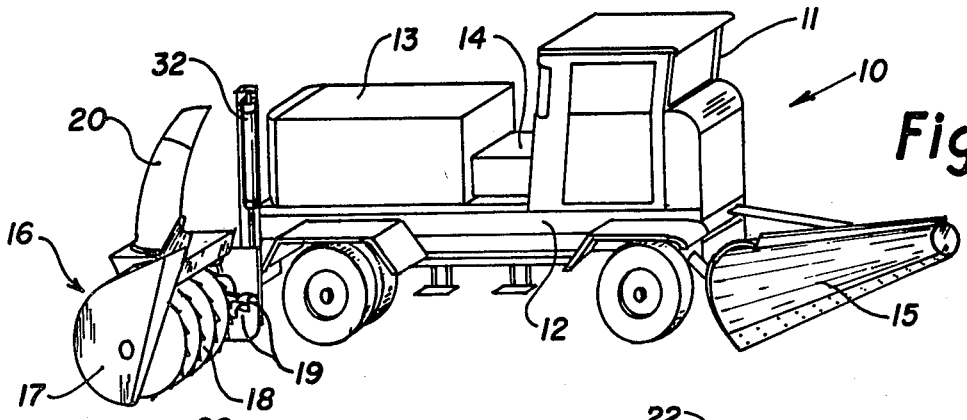
FIG. 1 is a perspective view of a snowblower-equipped truck assembly according to the present invention.
Figure 2:
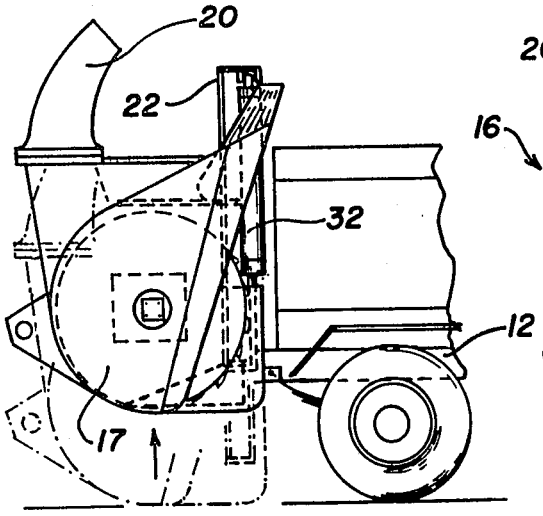
FIG. 2 is a side elevation view of the lateral swivelling snowblower equipment forming part of the truck assembly of FIG. 18 and shown in lifted position relative to the carrying truck.
Figure 3:
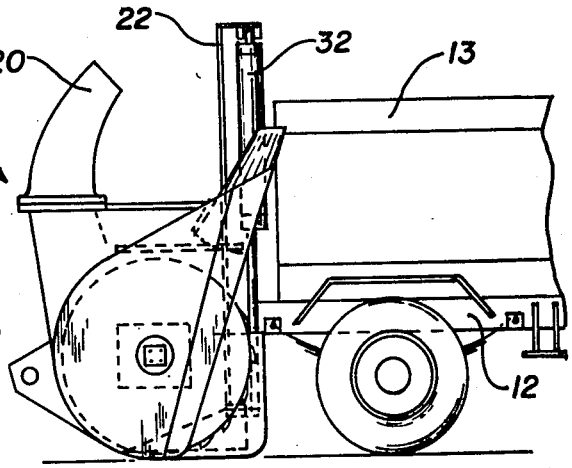
FIG. 3 is a side view as in FIG. 2, but with the snowblower equipment in lowered position.

The illustrated snowblower-equipped-truck assembly 10 comprises a cab 11, a frame 12 on the rear portion of which is mounted a housing 13 for a diesel engine for driving one or two hydraulic pumps located in housing 14. Each pump feeds a hydraulic motor driving a snowblower unit. One unit is mounted at the back side of the truck, as shown at 16, while the other unit may be mounted at the front of the truck in conventional manner. However, this front unit can be replaced by a one-way snow-plow 15, as shown.

The snowblower unit 16 is attached to the rear of the truck, but its detailed construction does not form part of the present invention; it is defined in applicant's copending patent application filed June 13, 1983 bearing Ser. No. 503,862, and entitled: "SNOWBLOWER AND SCARIFYING AUGER ASSEMBLY THEREFOR".

The illustrated snowblower unit 16 includes a trough-shape housing 17 defining an open front. A helicoid blade 18 and snow-throwing wheels 19 are conventionally mounted in the housing 17 to form a snow-blowing mechanism to throw the snow away through the ejection outlet 20. The helicoid blade 18 and the snow-throwing wheels 19 are fixed to a shaft rotatively driven by a hydraulic motor 21 fixed at the end of the housing 17 and fed by the pump in housing 14.

The snowblower unit 16 is attached to the rear frame 12 of the truck by a swivelling and lifting assembly to selectively lift and lower the snowblower unit relative to the rear frame and to selectively pivot the same between a lateral projecting position and a rearward projecting position relative to the rear frame. This swivelling and lifting assembly includes a pivot section secured against the edge of the rear frame and a complementary pivot section secured to the housing. The pivot section secured to the frame includes a lifting mechanism and a post 22 forming a guideway for it.

The post 22 is of channel construction to form a vertical slideway. A slide 23 is vertically slidable in the slideway defined by the post 22. An upper bracket 24 and a lower bracket 25 project from the slide 23 and are fixedly secured to it. The pivot section secured to the housing 17 of the snowblower unit includes a pivot connection bracket 26 including arms 27 and 28 fixedly secured to the housing and pivotally engaging a pair of upright pivots 29, 30. The latter upwardly project from the brackets 24, 25. A ballast 31 is mounted on the opposite side of the rear frame to balance the weight of the snowblower equipment particuarly when it projects laterally outward.

The lifting mechanism also includes a hydraulic cylinder 32 which is connected at its upper end by a bracket 33 to the upper end of the post 22 and its rod 34 to the lower bracket 25 fixed to the slide 23. The selective actuation of the lifting hydraulic cylinder 32 produces lifting and lowering of the slide and of the snowblower unit bodily with it.

Figure 4:
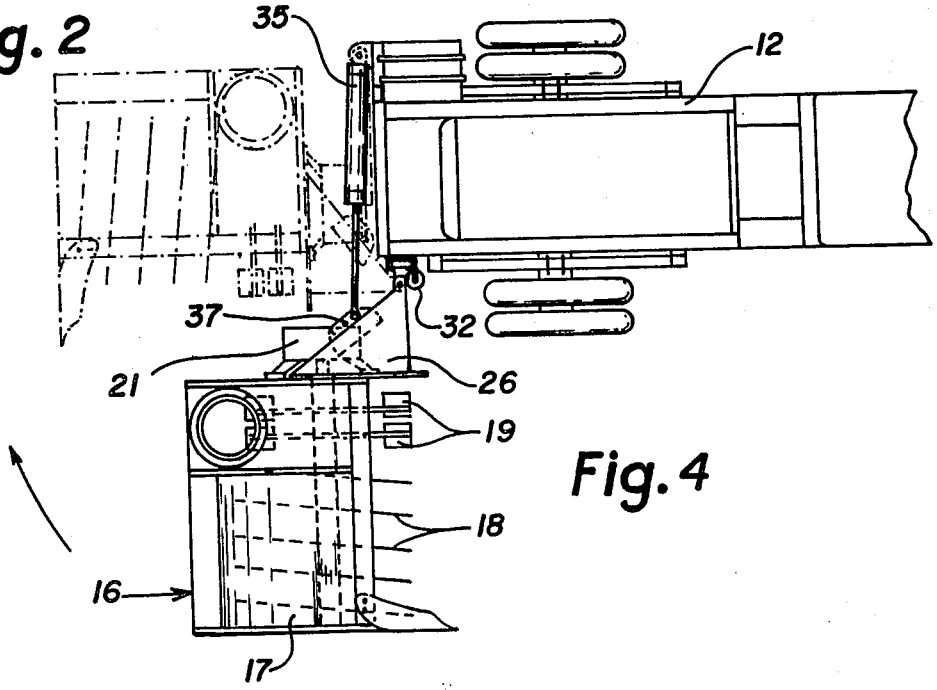
FIG. 4 is a top view of the rear portion of the snowblower-equipped truck assembly of FIG. 1.
Figure 6:
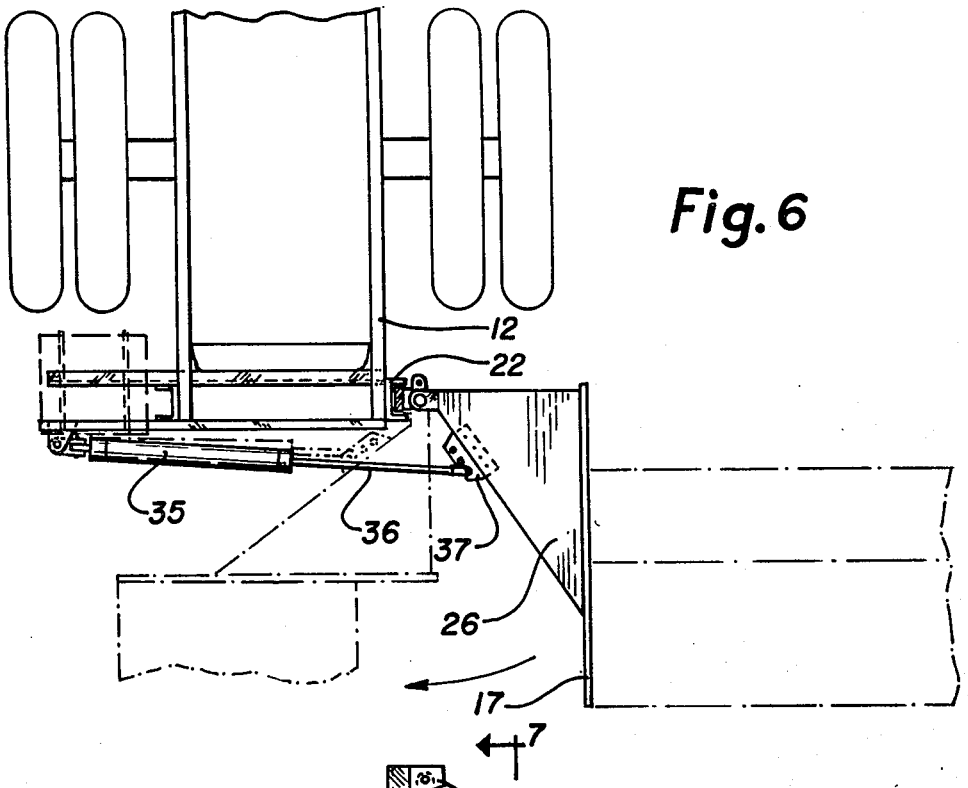
FIG. 6 is a cross-sectional view as seen along line 6–6 in FIG. 5.
Figure 5:
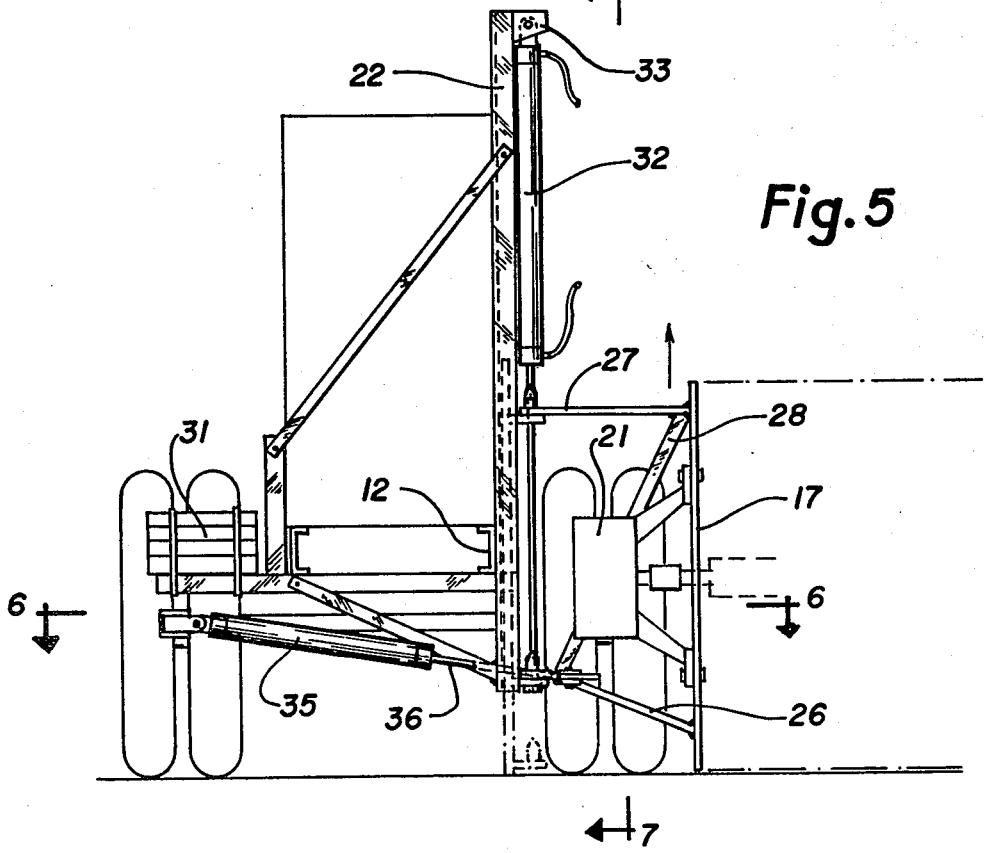
FIG. 5 is a rear elevation view of the snowblower-equipped truck assembly as seen from the left in FIG. 4.

A swivelling hydraulic cylinder 35 is pivotally connected at the rear frame 12 at one end and has its rod 36 pivotally and adjustably connected in one adjustment hole of a bracket 37 fixedly secured to the pivot connection bracket 26. This allows to selectively swivel the snowblower unit 16 between a lateral projecting position, as best shown in FIGS. 1, 4, and 5, and a rearward projecting position, as shown in dotted lines in FIGS. 4 and 6.

It must be noted that pins 38, or the like, engaging the upright pivots 29, 30 allow to readily disconnect the snowblower unit from the truck when not in use.

What I claim is:

1. A snowblower-equipped truck assembly comprising, in combination, a cab; a rear frame projecting rearward relative to the cab, and defining a usable platform behind the cab and a peripheral edge extending along the rear and the opposite sides of the rear frame; a snowblower unit including a housing, a snowblowing mechanism operatively rotatable in the housing and a motor connected to the snowblowing mechanism and operatively rotating the same; a post secured to the rear frame at the peripheral edge thereof and forming a vertically-extending slideway; a slide in vertical sliding engagement with the vertically-extending slideway; a pair of upright pivot elements are secured to the slide and cooperatively define a swivelling axis upwardly extending at the peripheral edge of the rear frame; a pivot connection bracket is fixedly connected to the snowblower unit and pivotally connected to the upright pivot elements; a lifting hydraulic cylinder connected to the slide and constructed and arranged for selective lifting and lowering of the snowblower unit relative to the rear frame; and a swivelling hydraulic cylinder connected to the pivot connection bracket and constructed and arranged for selective swivelling of the snowblower unit between a lateral projecting position and a rearward projecting position relative to the rear frame.

* * * * *